US009361828B2

(12) United States Patent
Tsai et al.

(10) Patent No.: US 9,361,828 B2
(45) Date of Patent: Jun. 7, 2016

(54) PIXEL DRIVING CIRCUIT FOR ORGANIC LIGHT EMITTING DIODE DISPLAY AND OPERATING METHOD THEREOF

(71) Applicant: AU Optronics Corporation, Hsin-Chu (TW)

(72) Inventors: Hsuan-Ming Tsai, Hsin-Chu (TW); Yen-Shih Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 104 days.

(21) Appl. No.: 14/510,719

(22) Filed: Oct. 9, 2014

(65) Prior Publication Data

US 2015/0339976 A1 Nov. 26, 2015

(30) Foreign Application Priority Data

May 20, 2014 (TW) ..... 103117613 A

(51) Int. Cl.
*G09G 3/32* (2016.01)

(52) U.S. Cl.
CPC ..... *G09G 3/3233* (2013.01); *G09G 3/3258* (2013.01); *G09G 2300/0819* (2013.01); *G09G 2300/0842* (2013.01); *G09G 2300/0861* (2013.01); *G09G 2300/0866* (2013.01); *G09G 2320/0233* (2013.01)

(58) Field of Classification Search
CPC ..... G09G 3/3233; G09G 3/32; G09G 3/3258; G09G 2300/0866; G09G 2320/0233
USPC ..... 315/172; 345/211, 76
See application file for complete search history.

(56) References Cited

U.S. PATENT DOCUMENTS

| | | | | |
|---|---|---|---|---|
| 9,269,296 | B2 * | 2/2016 | Pyon | G09G 3/3233 |
| 2007/0018917 | A1 | 1/2007 | Miyazawa | |
| 2011/0279435 | A1 | 11/2011 | Tsai et al. | |
| 2013/0002632 | A1 * | 1/2013 | Choi | G09G 3/325 345/211 |
| 2014/0368487 | A1 | 12/2014 | Chang et al. | |

FOREIGN PATENT DOCUMENTS

| | | |
|---|---|---|
| CN | 1897079 | 1/2007 |
| CN | 103489397 | 1/2014 |

* cited by examiner

*Primary Examiner* — Daniel D Chang
(74) *Attorney, Agent, or Firm* — WPAT, P.C.; Justin King

(57) ABSTRACT

A pixel driving circuit includes a first transistor, a second transistor, a third transistor, a fourth transistor, a fifth transistor, an organic light emitting diode, and a capacitor. The second transistor is electrically connected between a first end and a gate end of the first transistor. The third transistor is electrically connected between the first end of the first transistor and a first supply voltage source. The fourth transistor is electrically connected between a second end of the first transistor and a data input end. The fifth transistor is electrically connected to the second end of the first transistor. The organic light emitting diode is electrically connected between the fifth transistor and a second supply voltage source. The capacitor is electrically connected to the gate end of the first transistor.

4 Claims, 7 Drawing Sheets

PIXEL DRIVING CIRCUIT FOR ORGANIC LIGHT EMITTING DIODE DISPLAY AND OPERATING METHOD THEREOF

RELATED APPLICATIONS

This application claims priority to Taiwan Application Serial Number 103117613, filed May 20, 2014, which is herein incorporated by reference.

BACKGROUND

1. Field of Invention

The present disclosure relates to a pixel driving circuit. More particularly, the present disclosure relates to a OLED pixel driving circuit.

2. Description of Related Art

With advances in electronic technology, display panels are widely used in our daily lives, such as being used in mobile phones and computers.

A typical organic light emitting diode display includes a scan circuit, a data circuit, and a pixel array of pixel driving circuits. Each of the pixel driving circuits in the pixel array includes a driving transistor, a switching transistor and an organic light emitting diode. The scan circuit can sequentially generate a plurality of scan signals, and provide the scan signals to scan lines, so as to sequentially turn on the switching transistors of the pixel driving circuits. The data circuit can generate a plurality of data signals and provide the data signals to the driving transistors via the switching transistors which turn on, so as to enable the driving transistors to drive the organic light emitting diodes according to the data signals. With such operation, the organic light emitting diodes in the organic light emitting diode display are able to emit light and display images.

The amperage of the driving current provided to the organic light emitting diode by the driving transistor corresponds to the data signal and the threshold voltage of the driving transistor. However, threshold voltage offsets of the driving transistors in different pixel driving circuits may exist due to different operating conditions and manufacturing processes. These offsets may cause uneven brightness of the organic light emitting diodes, and ultimately result in mura defects.

Thus, an important area of research in this field involves ways in which to overcome such a problem.

SUMMARY

One aspect of the present disclosure is related to a pixel driving circuit for an organic light emitting diode. In accordance with one embodiment of the present disclosure, the pixel driving circuit includes a first transistor, a second transistor, a third transistor, a fourth transistor, a fifth transistor, an organic light emitting diode, and a capacitor. The first transistor includes a first end, a second end, and a gate end. The second transistor is electrically connected between the first end and the gate end of the first transistor. The third transistor is electrically connected between the first end of the first transistor and a first supply voltage source. The fourth transistor is electrically connected between the second end of the first transistor and a data input end. The fifth transistor electrically connected to the second end of the first transistor. The organic light emitting diode is electrically connected between the fifth transistor and a second supply voltage source. The capacitor is electrically connected to the gate end of the first transistor.

Another aspect of the present disclosure is related to a pixel driving circuit for an organic light emitting diode. In accordance with one embodiment of the present disclosure, the pixel driving circuit includes a first transistor, a second transistor, a third transistor, a fourth transistor, a fifth transistor, an organic light emitting diode, and a capacitor. The first transistor includes a first end, a second end, and a gate end. The second transistor includes a first end, a second end, and a gate end. The first end of the second transistor is electrically connected to the first end of the first transistor, the second end of the second transistor is electrically connected to the gate end of the first transistor, and the gate end of the second transistor is configured to receive a first scan signal. The third transistor includes a first end, a second end, and a gate end. The first end of the third transistor is electrically connected to a first supply voltage source, the second end of the third transistor is electrically connected to the first end of the first transistor, and the gate end of the third transistor is configured to receive an emitting signal. The fourth transistor includes a first end, a second end, and a gate end. The first end of the fourth transistor is electrically connected to a data input end, the second end of the fourth transistor is electrically connected to the second end of the first transistor, and the gate end of the fourth transistor is configured to receive a second scan signal. The fifth transistor includes a first end, a second end, and a gate end. The first end of the fifth transistor is electrically connected to the second end of the first transistor, and the gate end of the fifth transistor is configured to receive the emitting signal. The organic light emitting diode includes a first end and a second end. The first end of the organic light emitting diode is electrically connected to the second end of the fifth transistor, and the second end of the organic light emitting diode is electrically connected to a second supply voltage source. The capacitor includes a first end and a second end. The first end of the capacitor is configured to receive a third scan signal, and the second end of the capacitor is electrically connected to the gate end of the first transistor.

Through application of one embodiment described above, a pixel driving circuit for an organic light emitting diode can be realized. By using such a pixel driving circuit in a display panel, mura defects of the display panel caused by the threshold voltage offset of the first transistors (driving transistors) in pixel driving circuits can be avoided.

DETAILED DESCRIPTION

Figure 1:
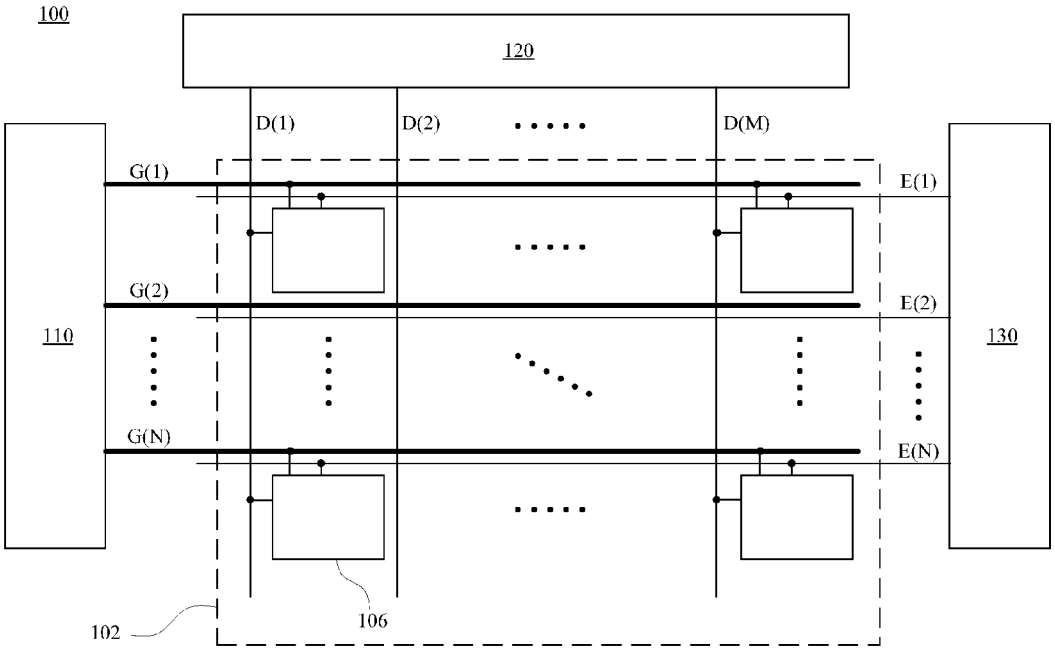
FIG. 1 is a schematic diagram of a display panel according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "connected" or "electrically connected" to another element, it can be directly connected or coupled to the other element or intervening elements may be present. In contrast, when an element is referred to as being "directly connected" to another element, there are no intervening elements present. Moreover, "connect" or "electrically connect" can further refer to the interoperation or interaction between two or more elements.

It will be understood that, in the description herein and throughout the claims that follow, unless otherwise defined, all terms (including technical and scientific terms) have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. §112(f). In particular, the use of "step of" in the claims herein is not intended to invoke the provisions of 35 U.S.C. §112(f).

FIG. 1 is a schematic diagram of a display panel 100 according to one embodiment of the present disclosure. The display panel 100 can include a scan circuit 110, a data circuit 120, an emitting signal generating circuit 130, and a pixel array 102. The pixel array 102 may include a plurality of pixel driving circuits 106 arranged in a matrix. The scan circuit 110 can sequentially generate a plurality of scan signals G(1), . . . , G(N) and provide the scan signals G(1), . . . , G(N) to the pixel driving circuit 106 in the pixel array 102, so as to sequentially turn on the pixel driving circuits 106, in which N is an integer. The data circuit 120 can generate a plurality of data signals D(1), . . . , D(M) and provide the data signals D(1), . . . , D(M) to the pixel driving circuits 106 which turn on, in which M is an integer. The emitting signal generating circuit 130 can sequentially generate a plurality of emitting signals E(1), . . . , E(N) and provide the emitting signals E(1), . . . , E(N) to the pixel driving circuits 106 which receive the data signals D(1), . . . , D(M), so as to enable the pixel driving circuits 106 which receive the emitting signals E(1), . . . , E(N) and the data signals D(1), . . . , D(M) to emit light. Through such operation, the display panel 100 can display images.

Figure 2:
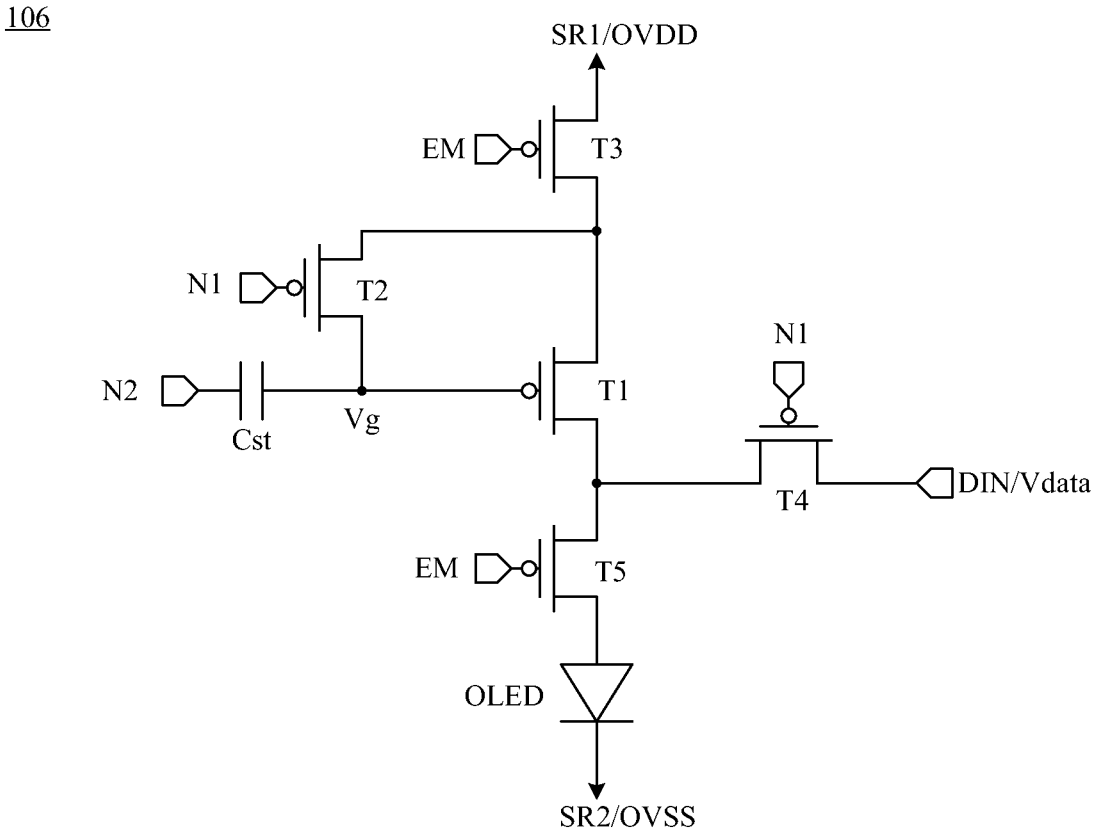
FIG. 2 is a schematic diagram of a pixel driving circuit according to one embodiment of the present disclosure.

FIG. 2 is a schematic diagram of the pixel driving circuit 106 according to one embodiment of the present disclosure. To simplify the description, only one pixel driving circuit 106 is taken as a descriptive example in the paragraphs below.

In this embodiment, the pixel driving circuit 106 receives one of the scan signals G(1), . . . , G(N) as scan signals N1, N2 (i.e., the one of the scan signals G(1), . . . , G(N) includes the scan signals N1, N2), receives one of the data signals D(1), . . . , D(M) as a data voltage Vdata, and receives one of the emitting signals E(1), . . . , E(N) as an emitting signal EM.

In this embodiment, the pixel driving circuit 106 includes a transistor T1, a transistor T2, a transistor T3, a transistor T4, a transistor T5, a capacitor Cst, and an organic light emitting diode OLED. The transistors T1-T5 can be realized by thin film transistors (TFTs).

In this embodiment, each of the transistors T1-T5 has a first end, a second end, and a gate end. The first end of the transistor T1 is electrically connected to the first end of the transistor T2 and the second end of the transistor T3. The second end of the transistor T1 is electrically connected to the second end of the transistor T4 and the first end of the transistor T5. The gate end of the transistor T1 is electrically connected to a second end of the capacitor Cst and the second end of the transistor T2. The gate end of the transistor T2 is configured to receive the scan signal N1. The first end of the transistor T3 is electrically connected to a supply voltage source SR1 which is configured to provide a supply voltage OVDD (e.g., +6V). The gate end of the transistor T3 is configured to receive the emitting signal EM. The first end of the transistor T4 is electrically connected to a data input end DIN which is configured to provide the data voltage Vdata. The gate end of the transistor T4 is configured to receive the scan signal N1. The second end of the transistor T5 is electrically connected to a first end (e.g., an anode end) of the organic light emitting diode OLED. The gate end of the transistor T5 is configured to receive the emitting signal EM. A second end (e.g., a cathode end) of the organic light emitting diode OLED is electrically connected to a supply voltage source SR2 which is configured to provide a supply voltage OVSS (e.g., −4V). A first end of the capacitor Cst is configured to receive the scan signal N2.

The operations of the pixel driving circuit 106 in one embodiment are described in the paragraphs below with reference to FIGS. 3A, 3B, 4A, 4B, 5A, and 5B.

Figure 3A:
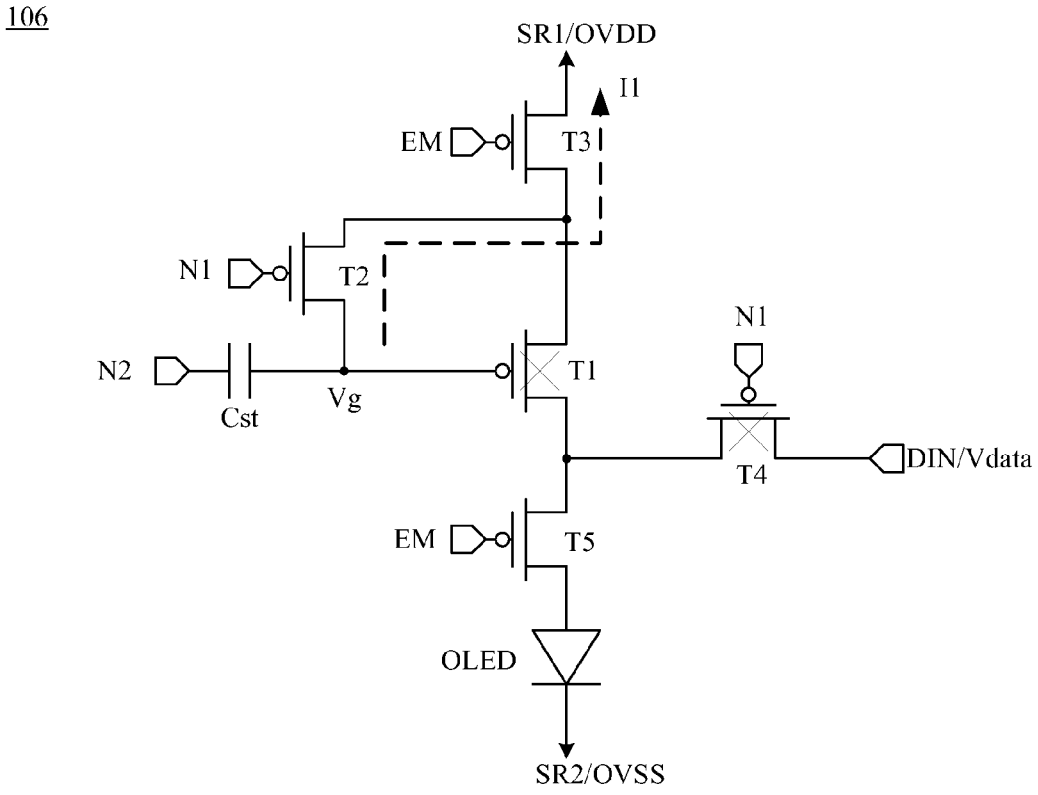
FIG. 3A is a schematic diagram of the pixel driving circuit according to one operative embodiment of the present disclosure.
Figure 3B:
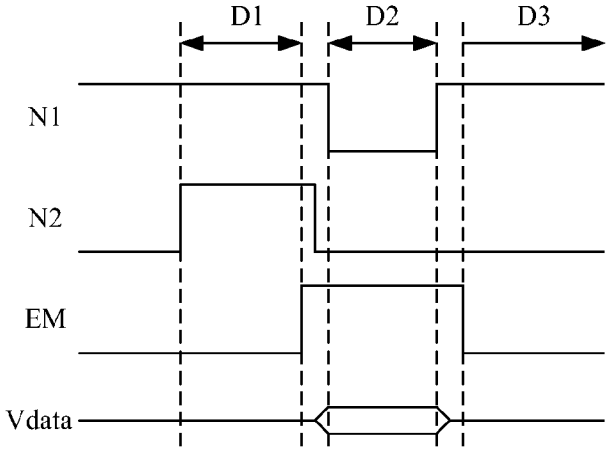
FIG. 3B illustrates signals of the pixel driving circuit shown in FIG. 3A.

Reference is now made to FIGS. 3A and 3B, in which FIG. 3A is a schematic diagram of the pixel driving circuit 106 according to one operative embodiment of the present disclosure, and FIG. 3B illustrates signals of the pixel driving circuit 106 shown in FIG. 3A.

In duration D1 (e.g., a reset state), the voltage level of the scan signal N2 is converted from a low voltage level (e.g., −4V) to a high voltage level (e.g., +6V). The capacitor Cst converts the voltage level Vg on the gate end of the transistor T1 to a first operating voltage level (e.g., converts the voltage level Vg from +2V to +12V) according to the conversion of the voltage level of the scan signal N2, so as to make the transistor T1 turn off.

The gate end of the transistor T2 receives the scan signal N1 with a high voltage level (e.g., +6V). Since the first operating voltage level on the gate end of the transistor T1 is higher than the high voltage level of the scan signal N1, the transistor T2 turns on and conducts the first end of the transistor T1 to the gate end of the transistor T1 according to the difference between the first operating voltage level and the high voltage level of the scan signal N1.

The transistor T3 conducts the supply voltage source SR1 to the first end of the transistor T1 according to the emitting signal EM with a low voltage level.

With such operation, charges in the capacitor Cst can be released to the supply voltage source SR1 by a current 11 via the transistors T2, T3, and the voltage level Vg on the gate end of the transistor T1 can be decreased corresponding to the release of the charges in the capacitor Cst. In one embodiment, the voltage level Vg on the gate end of the transistor T1 may be decreased to a value equal to a summation of a value of the supply voltage OVDD (e.g., +6V) and a norm value of a threshold voltage Vth_T2 of the transistor T2 (i.e., Vg=OVDD+|Vth_T2|). For example, when the supply voltage OVDD has a value of +6V and the norm value of the threshold voltage Vth_T2 of the transistor T2 is 2V, the voltage level Vg has a value of +8V. In addition, in one embodiment, the difference between the voltage levels of the two ends of the capacitor Cst may be decreased to a threshold voltage Vth_T2 of the transistor T2 at this time point.

Moreover, in duration D1, the transistor T4 turns off according to the high voltage level of the scan signal N1. The transistor T5 turns on according to a low voltage level of the emitting signal EM.

Figure 4A:
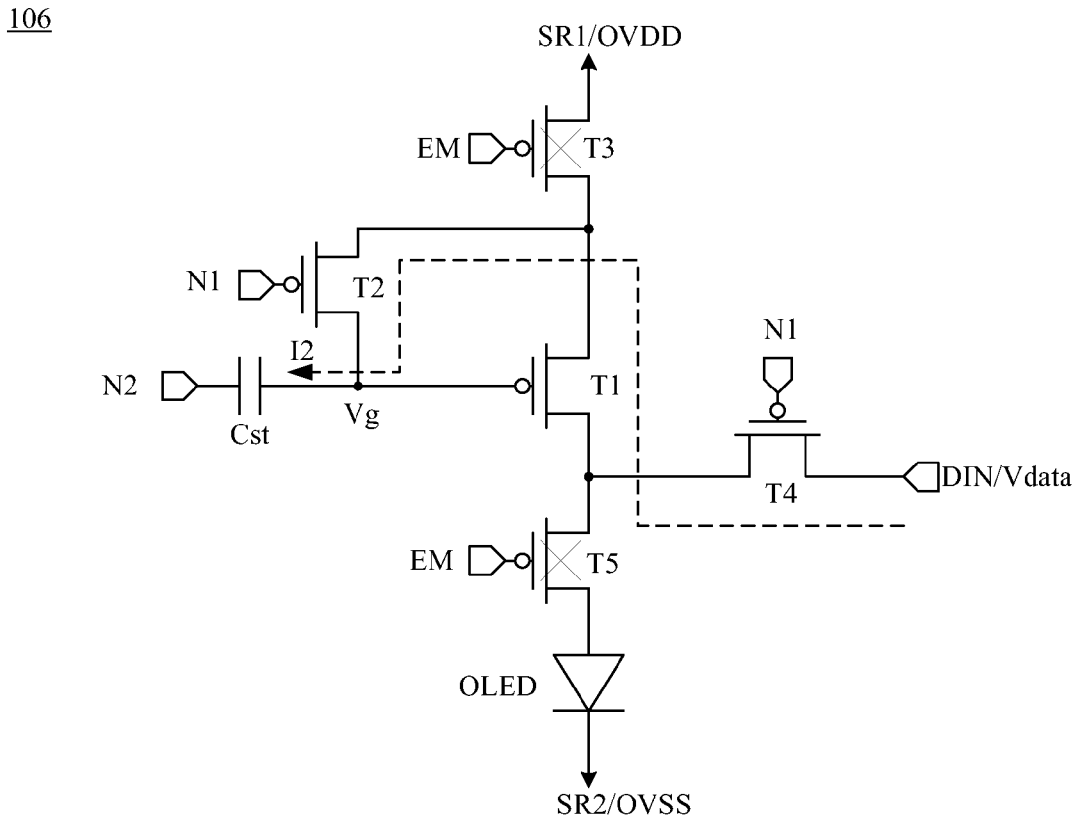
FIG. 4A is a schematic diagram of the pixel driving circuit according to one operative embodiment of the present disclosure.
Figure 4B:
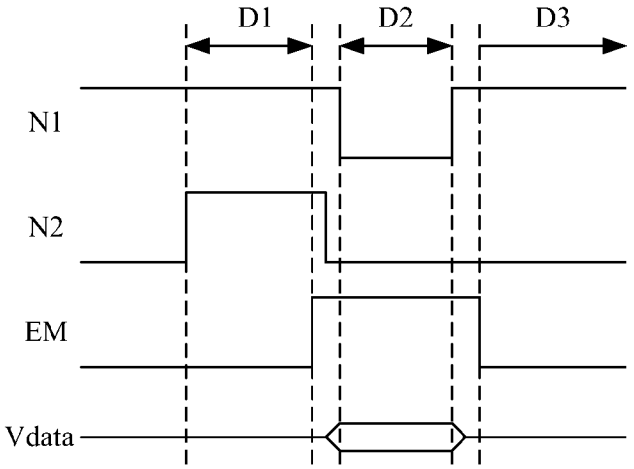
FIG. 4B illustrates signals of the pixel driving circuit shown in FIG. 4A.

Reference is now made to FIGS. 4A and 4B, in which FIG. 4A is a schematic diagram of the pixel driving circuit 106 according to one operative embodiment of the present disclosure, and FIG. 4B illustrates signals of the pixel driving circuit 106 shown in FIG. 4A.

In duration D2 (data write-in state), the transistors T3, T5 turn off according to the emitting signal EM with a high voltage level. The transistor T2 conducts the first end of the transistor T1 to the gate end of the transistor T1 according to the scan signal N1 with a low voltage level (for a preferred embodiment: −4V). The transistor T4 conducts the second end of the transistor T1 to the data input end DIN according to the scan signal N1 with the low voltage level.

Additionally, in duration D2, the voltage level of the scan signal N2 is converted from a high voltage level (e.g., +6V) to a low voltage level (e.g., −4V). The capacitor Cst converts the voltage level Vg on the gate end of the transistor T1 to a second operating voltage level (e.g., from +8V to −2V) according to the conversion of the voltage level of the scan signal N2, so as to make the transistor T1 turn on and conduct the first and second ends of the transistor T1 according to the second operating voltage level on the gate end of the transistor T1 and the data voltage Vdata on the second end of the transistor T1.

With such operation, the data input end DIN can provide a data current 12 to the capacitor Cst via transistors T4, T1, T2 to charge the capacitor Cst, until the voltage level Vg on the gate end of the transistor T1 reaches a value of the difference between the value of the data voltage Vdata and the norm value of the threshold voltage |Vth_T1|(i.e., Vdata−|Vth_T1|).

Figure 5A:
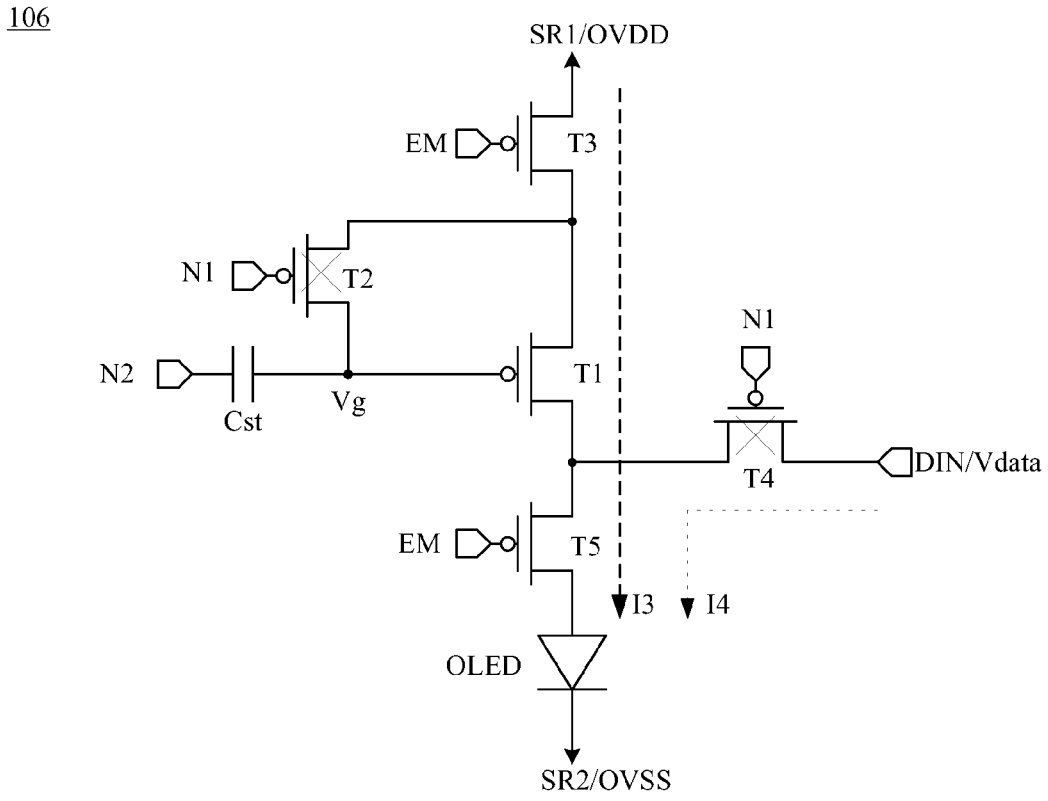
FIG. 5A is a schematic diagram of the pixel driving circuit according to one operative embodiment of the present disclosure.
Figure 5B:
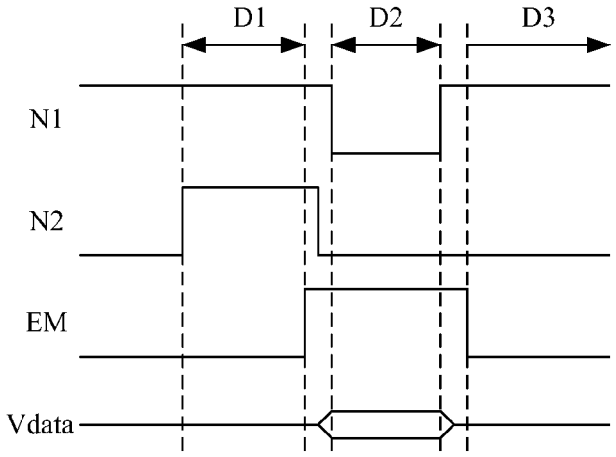
FIG. 5B illustrates signals of the pixel driving circuit shown in FIG. 5A.

Reference is now made to FIGS. 5A and 5B, in which FIG. 5A is a schematic diagram of the pixel driving circuit 106 according to one operative embodiment of the present disclosure, and FIG. 5B illustrates signals of the pixel driving circuit 106 shown in FIG. 5A.

In duration D3 (e.g., an emitting state), the transistors T2, T4 turn off according to the scan signal N1 with a high voltage level (e.g., +6V). The transistor T3 conducts the supply voltage source SR1 to the first end of the transistor T1 according to the emitting signal EM with a low voltage level. The transistor T5 conducts the first end of the organic light emitting diode OLED to the second end of the transistor T1. The transistor T1 provides a driving current 13 to the organic light emitting diode OLED according to the voltage level Vg on the gate end of the transistor T1 (e.g., equal to Vdata−|Vth_T1|). The organic light emitting diode OLED emits light according to the driving current 13 flowing through the transistors T1, T3, T5.

It should be noted that, in this embodiment, at this time, the voltage level on the first end of the transistor T1 is equal to the supply voltage OVDD. The voltage level Vg on the gate end of the transistor T1 is equal to Vdata−|Vth_T1|. The voltage level difference Vsg between the first and gate ends of the transistor T1 is equal to OVDD−Vdata+|Vth_T1|.

The amperage of the driving current 13 satisfies the following equation:

$$I3=(½)\times K\times(Vsg-|Vth_T1|)^2=(½)\times K\times(\mathrm{OVDD}-V\mathrm{data})^2.$$

In the preceding equation, K may be a constant. As presented in the preceding equation, the amperage of the driving current 13 corresponds to the values of the supply voltage OVDD and the data voltage Vdata, and is unrelated to the value of the threshold voltage Vth_T1 of the transistor T1.

Thus, by using the configuration described above, mura defects of the display panel 100 caused by the threshold voltage offset of the transistors T1 in different pixel driving circuits 106 can be avoided.

In addition, by using the configuration described above, in durations D2, D3, a voltage level difference between the supply voltage OVDD on the supply voltage source SR1 and the voltage level Vg on the gate end of the transistor T1 can be controlled within a specific value, such that a leakage current flowing through the transistors T2, T3 and caused by such a voltage level difference can be avoided (or suppressed). Thus, compared to a typical pixel driving circuit, the pixel driving circuit 106 in the present disclosure can be more stable.

In one embodiment, the transistor T4 may be implemented by a dual gate transistor, so as to decrease a leakage current 14 flowing through the transistor T4 which turns off in duration D3. With such a configuration, the stability of the pixel driving circuit 106 can be increased.

Moreover, it should be noted that, in the operations described above, the current direction of the data current 12 passing through the first transistor T1 (e.g., from the second end of the transistor T1 to the first end of the transistor T1) is opposite to the current direction of the driving current 13 passing through the first transistor T1 (e.g., from the first end of the transistor T1 to the second end of the transistor T1). By applying the data current 12 and the driving current 13 to the transistor T1 with different current directions, the lifetime of the transistor T1 can be increased, such that the stability of the transistor T1 can also be increased.

Furthermore, it should be noted that the values described in the paragraphs above are merely taken as descriptive examples, and other values are within the contemplated scope of the present disclosure.

Figure 6:
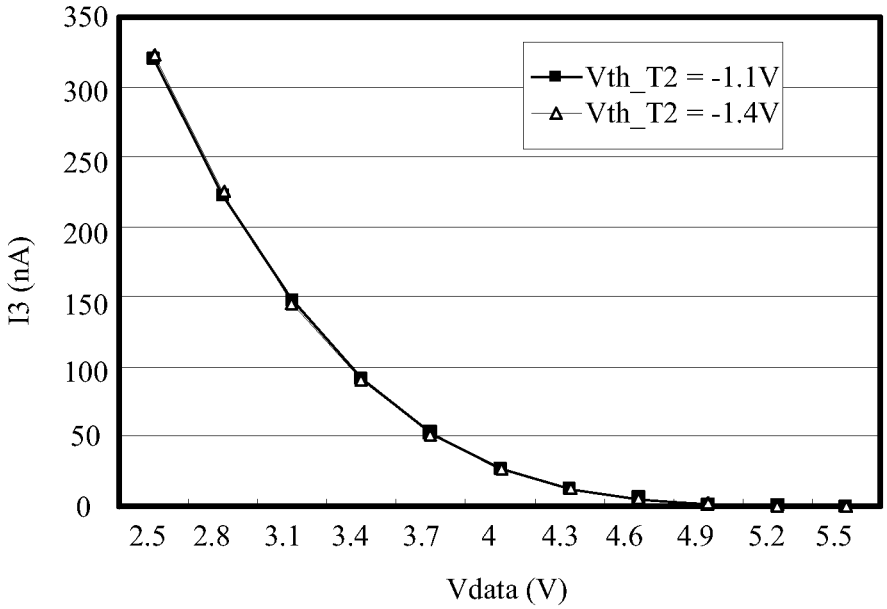
FIG. 6 illustrates voltage-current relationships of a transistor in different pixel driving circuits according to one exemplary embodiment of the present disclosure.

FIG. 6 illustrates voltage-current relationships of transistors T1 in different pixel driving circuits 106 according to one exemplary embodiment of the present disclosure. The relationship between a data voltage Vdata and a driving current corresponding to transistor T1 with a threshold voltage equal to −1.1V is substantially identical or similar to the relationship between a data voltage Vdata and a driving current corresponding to transistor T1 with a threshold voltage equal to −1.4V. As illustrated in FIG. 6, the configuration in one embodiment of the present disclosure can suppress the variance of the driving currents 13 caused by threshold voltage drift of the transistor T1.

Figure 7A:
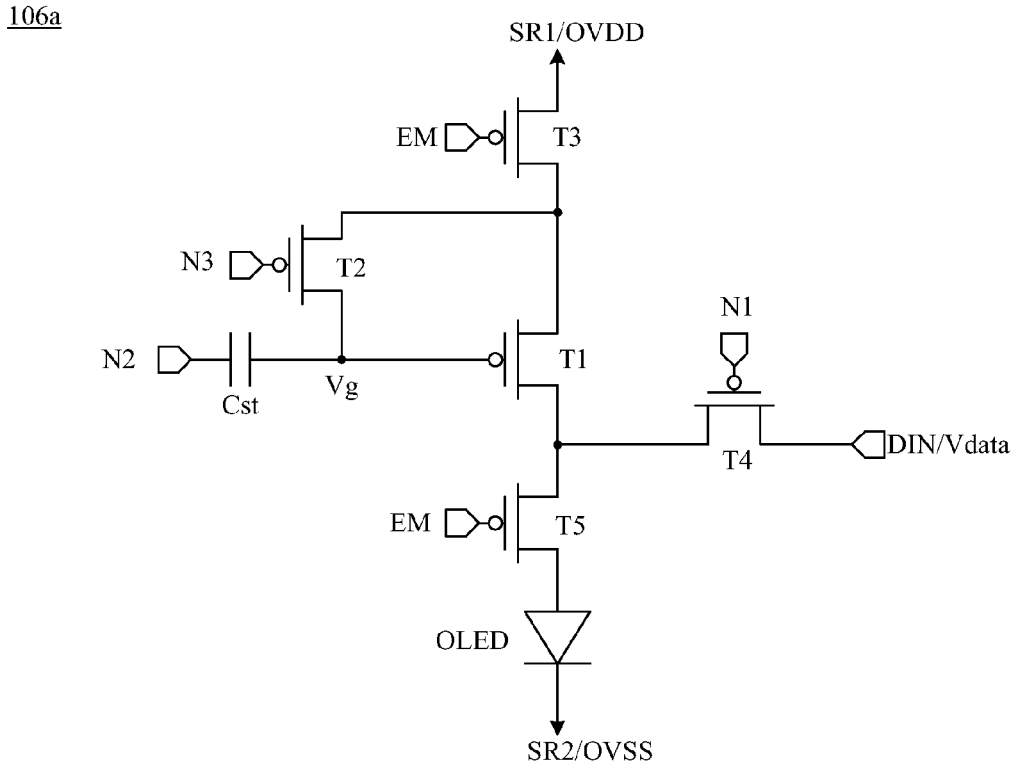
FIG. 7A is a schematic diagram of the pixel driving circuit according to another embodiment of the present disclosure.

FIG. 7A is a schematic diagram of the pixel driving circuit 106*a* according to another embodiment of the present disclosure. In this embodiment, the pixel driving circuit 106*a* includes a transistor T1, a transistor T2, a transistor T3, a transistor T4, a transistor T5, a capacitor Cst, and an organic light emitting diode OLED. The connections among the transistors T1-T5, the capacitor Cst, and the organic light emitting diode OLED in the pixel driving circuit 106*a* are substantially identical to the connections among these components in the pixel driving circuit 106 of previous embodiments. The main difference between the pixel driving circuit 106 and the pixel driving circuit 106*a* is that, in the pixel driving circuit 106*a*, the gate end of the transistor T2 is configured to receive a scan signal N3 which is different from the scan signals N1, N2. In the following paragraphs, the description will focus on aspects of this embodiment that are different from the previous embodiment, and aspects of this embodiment that are similar to those of the previous embodiment will not be repeated.

Figure 7B:
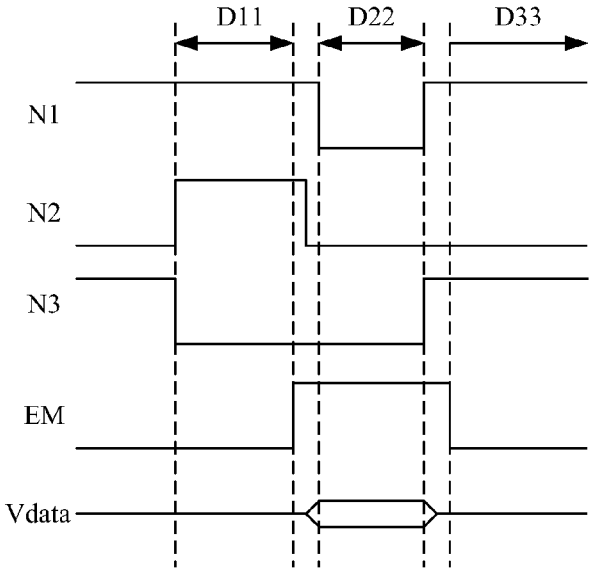
FIG. 7B illustrates signals of the pixel driving circuit shown in FIG. 7A.

Reference is made to both of FIGS. 7A and 7B, in which FIG. 7B illustrates signals of the pixel driving circuit 106*a* shown in FIG. 7A.

In duration D11 (e.g., a reset state), the transistor T2 conducts the first end of the transistor T1 to the gate end of the transistor T1 according to the scan signal N3 with a low voltage level (e.g., −4V). The transistor T3 conducts the supply voltage source SR1 to the first end of the transistor T1 according to the emitting signal EM with a low voltage level.

At this time, charges in the capacitor Cst can be released to the supply voltage source SR1 via the transistors T2, T3, and the voltage level Vg on the gate end of the transistor T1 can be decreased corresponding to the release of the charges in the capacitor Cst. In other words, at this time, the supply voltage source SR1 provides the supply voltage OVDD to the gate end of the transistor T1 to serve as the voltage level Vg on the gate end of the transistor T1 (e.g., Vg=OVDD). In one embodiment, the difference between the voltage levels on the two ends of the capacitor Cst may be decreased to 0.

It should be noted that details of operations performed in duration D11 can be ascertained by referring to the paragraphs in connection with duration D1, and a description in this regard will not be repeated herein.

In duration D22 (data write-in state), the transistor T2 turns on according to the scan signal N3 with a low voltage level (−4V), so as to conduct the first end of the transistor T1 to the gate end of the transistor T1. Details of operations performed in duration D22 can be ascertained by referring to the paragraphs in connection with duration D2, and a description in this regard will not be repeated herein.

In duration D33 (e.g., an emitting state), the transistor T2 turns off according to the scan signal N3 with a high voltage level (e.g., +6V). Details of operations performed in duration D33 can be ascertained by referring to the paragraphs in connection with duration D3, and a description in this regard will not be repeated herein.

Through such a configuration, another pixel driving circuit 106*a* for an organic light emitting diode can be realized. By using such a pixel driving circuit 106*a* in the display panel 100, the mura defects of the display panel 100 caused by the threshold voltage offset of the transistors T1 in different pixel driving circuits 106 can be avoided.

Although the present disclosure has been described in considerable detail with reference to certain embodiments thereof, other embodiments are possible. Therefore, the scope of the appended claims should not be limited to the description of the embodiments contained herein.

What is claimed is:

1. A pixel driving circuit for an organic light emitting diode comprising:

a first transistor comprising a first end, a second end, and a gate end;

a second transistor comprising a first end, a second end, and a gate end, wherein the first end of the second transistor is electrically connected to the first end of the first transistor, the second end of the second transistor is electrically connected to the gate end of the first transistor, and the gate end of the second transistor is configured to receive a first scan signal;

a third transistor comprising a first end, a second end, and a gate end, wherein the first end of the third transistor is electrically connected to a first supply voltage source, the second end of the third transistor is electrically connected to the first end of the first transistor, and the gate end of the third transistor is configured to receive an emitting signal;

a fourth transistor comprising a first end, a second end, and a gate end, wherein the first end of the fourth transistor is electrically connected to a data input end, the second end of the fourth transistor is electrically connected to the second end of the first transistor, and the gate end of the fourth transistor is configured to receive a second scan signal;

a fifth transistor comprising a first end, a second end, and a gate end, wherein the first end of the fifth transistor is electrically connected to the second end of the first transistor, and the gate end of the fifth transistor is configured to receive the emitting signal;

an organic light emitting diode comprising a first end and a second end, wherein the first end of the organic light emitting diode is electrically connected to the second end of the fifth transistor, and the second end of the organic light emitting diode is electrically connected to a second supply voltage source; and a capacitor comprising a first end and a second end, wherein the first end of the capacitor is configured to receive a third scan signal, and the second end of the capacitor is electrically connected to the gate end of the first transistor.

2. The pixel driving circuit as claimed in claim 1, wherein under a condition that the first transistor turns off, and the second transistor and the third transistor turn on, charges in the capacitor are released to the first supply voltage source via the second transistor and the third transistor.

3. The pixel driving circuit as claimed in claim 1, wherein under a condition that the third transistor and the fifth transistor turn off, and the first transistor, the second transistor, and the fourth transistor turn on, the data input end provides a data current to the capacitor via the first transistor, the second transistor, and the fourth transistor.

4. The pixel driving circuit as claimed in claim 1, wherein under a condition that the second transistor and the fourth transistor turn off, and the first transistor, the third transistor, and the fifth transistor turn on, the first supply voltage source provides a driving current to the organic light emitting diode via the first transistor, the third transistor, and the fifth transistor, so as to enable the organic light emitting diode to emit light.

* * * * *